US007653340B2

(12) United States Patent
Shida et al.

(10) Patent No.: US 7,653,340 B2
(45) Date of Patent: Jan. 26, 2010

(54) DECURL DEVICE AND IMAGE FORMING APPARATUS PROVIDED THEREWITH

(75) Inventors: Toshio Shida, Higashiyamato (JP); Masashi Kougami, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 491 days.

(21) Appl. No.: 11/714,848

(22) Filed: Mar. 7, 2007

(65) Prior Publication Data

US 2007/0280765 A1 Dec. 6, 2007

(30) Foreign Application Priority Data

May 30, 2006 (JP) ..... 2006-149483

(51) Int. Cl.
*G03G 15/00* (2006.01)

(52) U.S. Cl. ..... 399/406; 399/407

(58) Field of Classification Search ..... 399/406, 399/407

See application file for complete search history.

(56) References Cited

U.S. PATENT DOCUMENTS 4,765,223 A * 8/1988 Beckmann ..... 89/33.04

FOREIGN PATENT DOCUMENTS

| | | | | |
|---|---|---|---|---|
| JP | 60 052459 | A | | 3/1985 |
| JP | 61 002654 | A | | 1/1986 |
| JP | 61 130157 | A | | 6/1986 |
| JP | 61 239274 | A | | 10/1986 |
| JP | 5-238624 | | | 9/1993 |
| JP | 08002765 | A | * | 1/1996 |
| JP | 09 086760 | A | | 3/1997 |
| JP | 11 124269 | A | | 5/1999 |
| JP | 2002-60112 | | | 2/2002 |
| JP | 2002-80158 | | | 3/2002 |
| JP | 2005 053607 | A | | 3/2005 |
| JP | 2006089180 | A | * | 4/2006 |
| JP | 2006124092 | A | * | 5/2006 |

* cited by examiner

*Primary Examiner*—Judy Nguyen
*Assistant Examiner*—Allister Primo
(74) *Attorney, Agent, or Firm*—Finnegan, Henderson, Farabow, Garrett & Dunner, L.L.P.

(57) ABSTRACT

A decurl device includes: a curl detecting section having a plurality of toothed wheels each which detects a curling amount and a curling direction of a sheet having a curl; and a plurality of uncurling sections each arranged downstream of the curl detecting section in a conveyance direction of the sheet having the curl, which uncurls the sheet by bending and transforming the sheet in a direction reverse to a curling direction thereof. One of the uncurling sections, which reduces the curl, is selected on the basis of the curling amount and the curling direction that have been detected by the curl detecting section, thereby uncurling the sheet.

12 Claims, 6 Drawing Sheets

DECURL DEVICE AND IMAGE FORMING APPARATUS PROVIDED THEREWITH

This application is based on Japanese Patent Application No. 2006-149483 filed on May 30, 2006, the content of which is hereby incorporated by reference.

BACKGROUND OF THE INVENTION

The present invention relates to a decurl device which detects a curl of a sheet and uncurls the sheet, and an image forming apparatus provided with the decurl device.

An electrophotographic image forming apparatus, i.e., a copy machine, a printer, a facsimile or a multi-functional machine having the functions thereof, performs image formation by transferring a toner image, obtained by developing an electrostatic latent image formed on an image carrier, with a developing device, on a sheet directly or via an intermediate transfer member, then feeding the sheet through a pressuring position between a heat roller for fixing or a fixing belt and a pressure roller to fix the image.

In a fixing process, dehydration of a sheet causes so-called curling, a phenomenon such that the sheet after fixing warps upward or downward in a wavy form. Particularly, such curling of a sheet tends to noticeably occur due to increased amounts of toners supplied to the sheet at the time of forming a color image, the use of multifarious kinds of sheets, etc.

A curl of a sheet raises a problem particularly in a case of forming images on both sides of a sheet or a case of making an article bound by bookbinding or so in a finisher.

There is a case where a decurl member for correcting a curl of a sheet which occurs after fixing is used to avoid reduction in image quality or so originating from paper jamming, reduced sheet storability in a sheet ejecting section, a transfer failure at the time of double-side image formation, or the like all caused by such a curl.

A sheet curl control apparatus described in Unexamined Japanese Patent Application No. 05-238624 (FIG. 4) has a decurler and adjusting means which adjusts the decurling action of the decurler, detects the amount of curling by measuring a time interval between the first interruption of an infrared ray irradiated from one light source by passing of the leading edge of a sheet and the next interruption of the infrared ray using infrared sensors at two locations, and changes the decurling action according to the curling amount.

In above-mentioned sheet curl control apparatus, as the sensors are disposed downstream of a sheet in the sheet conveying direction, the sensors detect a curl at the leading edge of a sheet in the sheet conveying direction but cannot detect a curl which occurs on the entire surface of the sheet. Because a curl is detected by a horizontal sheet conveying section, the curling amount changes due to the dead weight of the sheet, disabling detection of the accurate curling amount.

A sheet conveying device described in Unexamined Japanese Patent Application No. 2002-60112 (FIG. 1) detects a curling amount with a reflection type displacement sensor, and performs such control as to change the sheet suction force generated by a suction fan according to the detected sheet curling amount.

Because the sheet conveying device also has the sensor disposed at an end portion of a sheet to detect the amount of displacement of the leading edge of the sheet in the sheet conveying direction at the horizontal sheet conveying section, it also cannot detect an accurate curling amount.

A decurl system described in Unexamined Japanese Patent Application No. 2002-80158 comprises decurl devices, curling amount measuring devices and correction amount modifying means, and detects a curling amount by the displacement of an actuator or a reflection type displacement sensor.

In this system, a curl is detected in the vicinity of the decurl device on the downstream side in the sheet conveying direction to detect the curling amount after the sheet is uncurled.

SUMMARY OF THE INVENTION

One aspect of the present invention is a decurl device including a curl detecting section having a plurality of toothed wheels which detect a curling amount and a curling direction of a curled sheet, and a plurality of uncurling sections which are disposed downstream of the curl detecting section in a sheet conveying direction and uncurls the sheet by warping the curled sheet in the opposite direction to the direction of curling, whereby the uncurling section that reduces the curl is selected from the plurality of uncurling sections to uncurl the sheet based on the curling amount and the curling direction detected by the curl detecting section.

Another aspect of the invention is an image forming apparatus including an image forming apparatus main body which forms an image on a sheet, a decurl device as recited above, and a sheet finisher which performing a finishing process on the sheet ejected from the decurl device.

DETAILED DESCRIPTION OF THE PREFERRED EMBODIMENT

While a preferred embodiment of the present invention will be described below, the invention is not limited to the embodiment.

Figure 1:
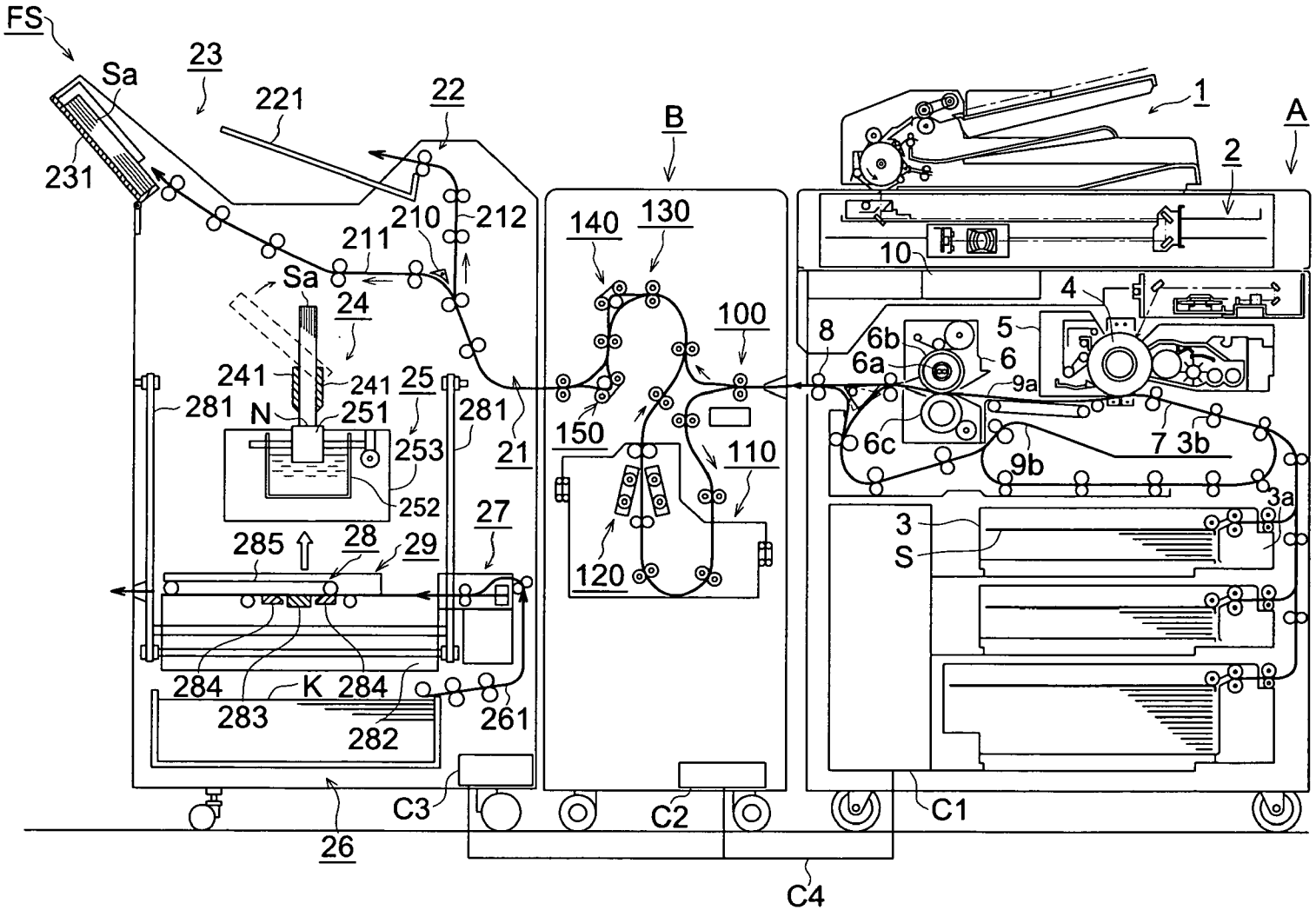
FIG. 1 is a general view of an image forming apparatus according to an embodiment of the present invention.

FIG. 1 is a general view of an image forming apparatus according to an embodiment of the present invention. The image forming apparatus includes an image forming apparatus main body A, a decurl device B and a sheet finisher FS.

[Image Forming Apparatus]

The image forming apparatus main body A has an automatic document feeder 1 and an image reading section 2 at an upper portion, and a printer section constituting a lower portion.

Reference numeral "3" denotes a sheet storing section which stores sheets S. A printer engine 5 forms an image on a photoreceptor 4 by an electrophotographic process of charging, exposing the photoreceptor 4 and developing. The printer engine 5 forms an image on a sheet S, and the image is fixed in a fixing unit 6. The fixing unit 6 forms a nip with a heat roller 6*b* with a built-in heat source 6*a*, and a pressure roller 6*c*, and heats and presses the sheet S while conveying the sheet S to melt toners, and fixes the image on the sheet S.

The sheet S is fed by a first sheet feeder 3*a* and is temporarily stopped and then fed by a second sheet feeder 3*b* to have an image formed thereon. The image-formed sheet S is ejected from sheet ejection ports by ejection rollers 8.

As conveyance paths for the sheet S, a sheet feeding path 7 from the sheet storing section 3 to the printer engine 5, a conveyance path 9*a* which extends from the printer engine 5 to a sheet ejection port passing through the fixing unit 6 and the ejection rollers 8, and a rear surface conveyance path 9*b* which effects a flipped-over conveyance.

Image forming modes include a one-side face-down ejection mode, a one-side face-up ejection mode and a two-side mode. In one-side face-down ejection mode, an image is formed on one side of a sheet S, and the sheet S having passed the fixing unit 6 is flipped over by the flip-over process, and then conveyed and ejected by the ejection rollers 8.

In one-side face-up ejection mode, an image is formed on one side of a sheet S, and the sheet S conveyed to the conveyance path 9*a* is directly conveyed and ejected by the ejection rollers 8.

In two-side mode, an image is formed on one side of a sheet S, and the sheet S having passed the fixing unit 6 is conveyed downward to the rear surface conveyance path 9*b*, is flipped over, and then fed again to the sheet feeding path 7.

The printer engine 5 forms a back image on the bottom side of the sheet S fed again, and the sheet S having the back image formed thereon passes through the fixing unit 6, and is conveyed and ejected by the ejection rollers 8.

Reference numeral "10" denotes an operation section, and various modes of the image forming apparatus main body A and the output mode using the sheet finisher FS can be set by operating the operation section 10.

A controller C1 provided in the image forming apparatus main body A is connected to a controller C2 of the decurl device B and a controller C3 of the sheet finisher FS via a communication section C4.

The sheet S ejected from the image forming apparatus main body A is conveyed to the sheet finisher FS through the decurl device B. The decurl device B will be described later.

[Sheet Finisher]

The sheet finisher FS, which performs various finishing processes on the sheet S ejected from the image forming apparatus main body A, is the generic term of a puncher, a folder, a flat binder, a center-binder, a pasting and bookbinding machine, a cutting machine and the like.

A pasting and bookbinding machine as a typified example will be explained as one embodiment of the sheet finisher FS.

The pasting and bookbinding machine is provided with a sheet take-in section 21, an ejection section 22, a sheet bundle storing section 23, a sheet bundle conveying section 24, a paste coating section 25, a cover sheet feeding section 26, a cover sheet cutting section 27, a cover sheet wrapping section (wrapping and bookbinding section) 28, and an aligning section 29. Those sections are disposed in the pasting and bookbinding machine nearly in the vertical direction.

The sheet S supplied to the sheet take-in section 21 is conveyed to either the ejection section 22 or the sheet bundle storing section 23 by a switching gate 210.

When sheet conveyance to the ejection section 22 is set, the switching gate 210 blocks a conveyance path 211 to the sheet bundle conveying section 24 and releases a conveyance path 212 to the ejection section 22. The sheets S, which pass along the conveyance path 212 to the ejection section 22, are conveyed upward to be stored on a fixed sheet ejection tray 221 located at the topmost portion of the sheet finisher FS.

The sheets S, which are branched leftward and conveyed in the illustration, at the downstream of the sheet conveying direction, by the switching gate 210, are stored and stacked in the sheet bundle storing section 23 at a predetermined position in order, and are aligned widthwise and vertically to form a sheet bundle Sa containing a predetermined number of sheets S.

The sheet bundle Sa stacked on a sheet placing table 231 of the sheet bundle storing section 23 is conveyed obliquely downward, held by a holding member 241 of the sheet bundle conveying section 24, and is rotated so that the side (spine portion) where a paste coating process is performed on the sheet bundle Sa while holding the sheet bundle Sa faces down, and is stopped at a predetermined position.

The paste coating section 25 includes a paste coating roller 251, a paste container 252, and a moving body 253 which can move to a paste coating position on the front side from the initial position of the spine side of the pasting and bookbinding machine while supporting the paste container 252.

A cover sheet K stored in the cover sheet feeding section 26 is conveyed to the cover sheet wrapping section 28 along a sheet conveyance path 261 through the cover sheet cutting section 27, and then has the trailing edge cut to have a predetermined length by the cover sheet cutting section 27. The cut length of the cover sheet K is the length of two sheets S in the moving direction plus the length of the spine of the sheet bundle Sa.

The cover sheet wrapping section 28 receives and conveys the cover sheet K supplied from the cover sheet feeding section 26, stops the cover sheet K at a predetermined position and performs widthwise positioning thereof by the aligning section 29. The cover sheet wrapping section 28 moves a moving case 282 upward by a rise-and-fall section 281, so that the center portion of the cover sheet K placed on a pressure member 283 is pressed against, and adhered to, a paste coated surface N of the sheet bundle Sa at the lift-up position.

The downward movement of the pressure member 283 facing the spine of the sheet bundle Sa and the movement of a pair of horizontally symmetrical folding members 284 disposed at the upper portion of the cover sheet wrapping section 28 causes the cover sheet K to be folded along the side edge of the paste coated surface N of the sheet bundle Sa, thus forming a sheet bundle Sa having the cover sheet K attached to the top and bottom sides of the sheet bundle Sa.

After the process of folding the cover sheet K, the cover sheet wrapping section 28 moves downward with the downward driving by the rise-and-fall section 281, after which an ejection belt 285 which has been retracted outward in the widthwise direction of the cover sheet K with the retraction of the aligning section 29 moves into the widthwise internal space under the sheet bundle Sa and stops there. When holding by the holding member 241 is released thereafter, the sheet bundle Sa moves downward and stops at a position where the lower spine of the sheet bundle Sa abuts on the top surface of the ejection belt 285. The rotating ejection belt 285 ejects a booklet wrapped and bookbound with the cover sheet K pasted adhered thereto outside the finisher.

[Decurl Device]

Figure 2:
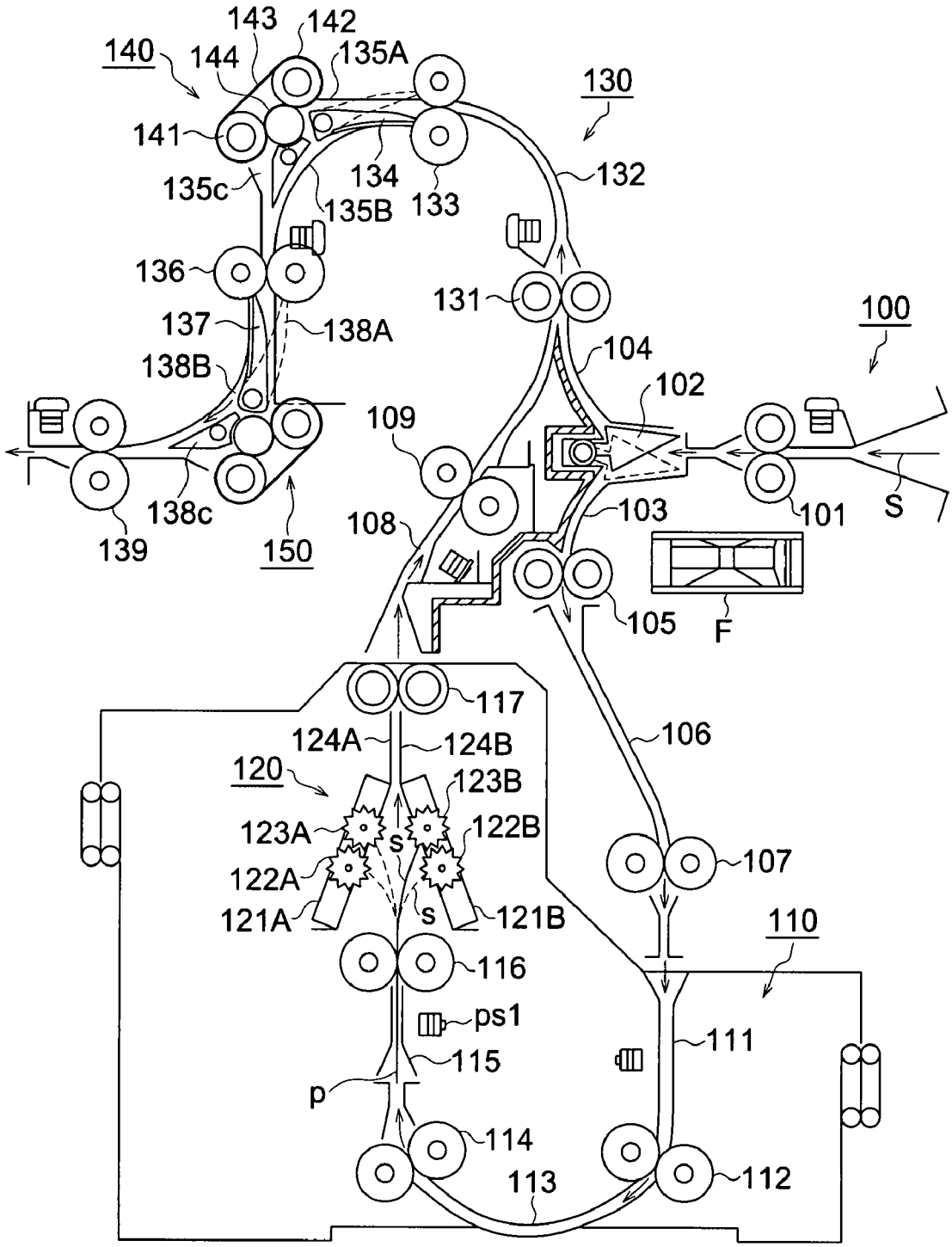
FIG. 2 is a cross-sectional view of a decurl device according to an embodiment of the present invention.

FIG. 2 is a cross-sectional view of the decurl device B according to an embodiment of the present invention.

The decurl device B is provided with a sheet introducing section 100, a decurl and conveying section 110, a curl detecting section 120, an uncurling and conveying section 130, a first uncurling section 140, and a second uncurling section 150.

The sheet S having an image formed thereon by the image forming section of the image forming apparatus main body A is ejected through the fixing unit 6 and the ejection rollers 8, is introduced to the sheet introducing section 100 of the decurl device B, and is conveyed while being held by conveyance rollers 101. A fan F disposed near the conveyance rollers 101 drops the temperature of the sheet S to be ejected from the image forming apparatus.

A switching gate 102 disposed downstream of the conveyance rollers 101 in the sheet conveying direction selectively switches the conveyance of the sheet S to a conveyance path 103 below or a bypass conveyance path 104 above.

The sheet S to be introduced to the conveyance path 103 is interposed and conveyed to the decurl and conveying section 110 by conveyance rollers 105, 107 along a conveyance path 106.

The sheet S conveyed into the decurl and conveying section 110 passes through a guide plate 111, is interposed by conveyance rollers 112, is conveyed in U-turn by a guide plate 113, is held vertically upward by conveyance rollers 114 and is conveyed to the curl detecting section 120 interposed by conveyance rollers 116, passing through a guide plate 115. A sensor PS1 which detects the passing of the leading edge of the sheet S is disposed upstream of conveyance rollers 116 in the sheet conveying direction.

The curl detecting section 120 will be described later referring to FIGS. 3 and 4.

After the curling amount and the curling direction of the sheet S are detected by the curl detecting section 120, the sheet S passes between a pair of guide plates 124A, 124B and is interposed and ejected from the decurl and conveying section 110 by conveyance rollers 117.

The sheet S ejected from the decurl and conveying section 110 passes along a conveyance path 108, and is interposed and supplied to conveyance rollers 131 of the uncurling and conveying section 130 by conveyance rollers 109.

Either the sheet S which passes along the bypass conveyance path 104 or the sheet S which is ejected from the curl detecting section 120 through the decurl and conveying section 110 and passes along the conveyance path 108 is supplied to the conveyance rollers 131 of the uncurling and conveying section 130.

The sheet S conveyed by the conveyance rollers 131 passes along a conveyance path 132, and is branched to either one of an upper conveyance path 135A and a lower conveyance path 135B formed by a switching gate 134 which is actuated by an unillustrated drive member.

After a concave curl upward of the sheet S conveyed by the upper conveyance rollers 135A is uncurled by the first uncurling section 140 to be described later, the sheet S is conveyed downward by conveyance rollers 136 along a vertically underlying conveyance path 135C. The sheet S which does not need uncurling is conveyed downward by the conveyance rollers 136 along the lower conveyance path 135B by path switching carried out by the switching gate 134.

The sheet S conveyed by the conveyance rollers 136 is branched to either one of a rightward conveyance path 138A and a leftward conveyance path 138B formed by a switching gate 137 which is actuated by an unillustrated drive member.

After a convex curl upward of the sheet S conveyed by the rightward conveyance rollers 138A is uncurled by the second uncurling section 150 to be described later, the sheet S is ejected out of the apparatus by ejection rollers 139 along a conveyance path 138C.

The sheet S which does not need uncurling is ejected out of the apparatus by the ejection rollers 139 along the leftward conveyance path 138B.

Selection of uncurling of the sheet S by the first uncurling section 140 and the second uncurling section 150 and whether uncurling is needed or not, are carried out based on the curling direction and the curling amount which are detected by the curl detecting section 120, that will be described later.

[Uncurling Section]

Because the first uncurling section 140 and the second uncurling section 150 have substantially the same configuration, the first uncurling section 140 will be described as a typified example.

The first uncurling section 140 has a drive roller 141 which is rotated by an unillustrated drive member, a belt 143 wound around the drive roller 141 and drive roller 142, a pressure roller 144 which is rotated pressed against the belt 143, and a drive member which selectively presses the pressure roller 144 against the belt 143.

As the sheet S conveyed along the conveyance path 135A passes through the pressing position where the pressure roller 144 is pressed against the belt 143, the sheet is uncurled. The pressure of the pressure roller 144 applied to the belt 143 is variably adjusted according to the curling amount of the sheet by an unillustrated drive member.

[Curl Detecting Section]

Figure 3:
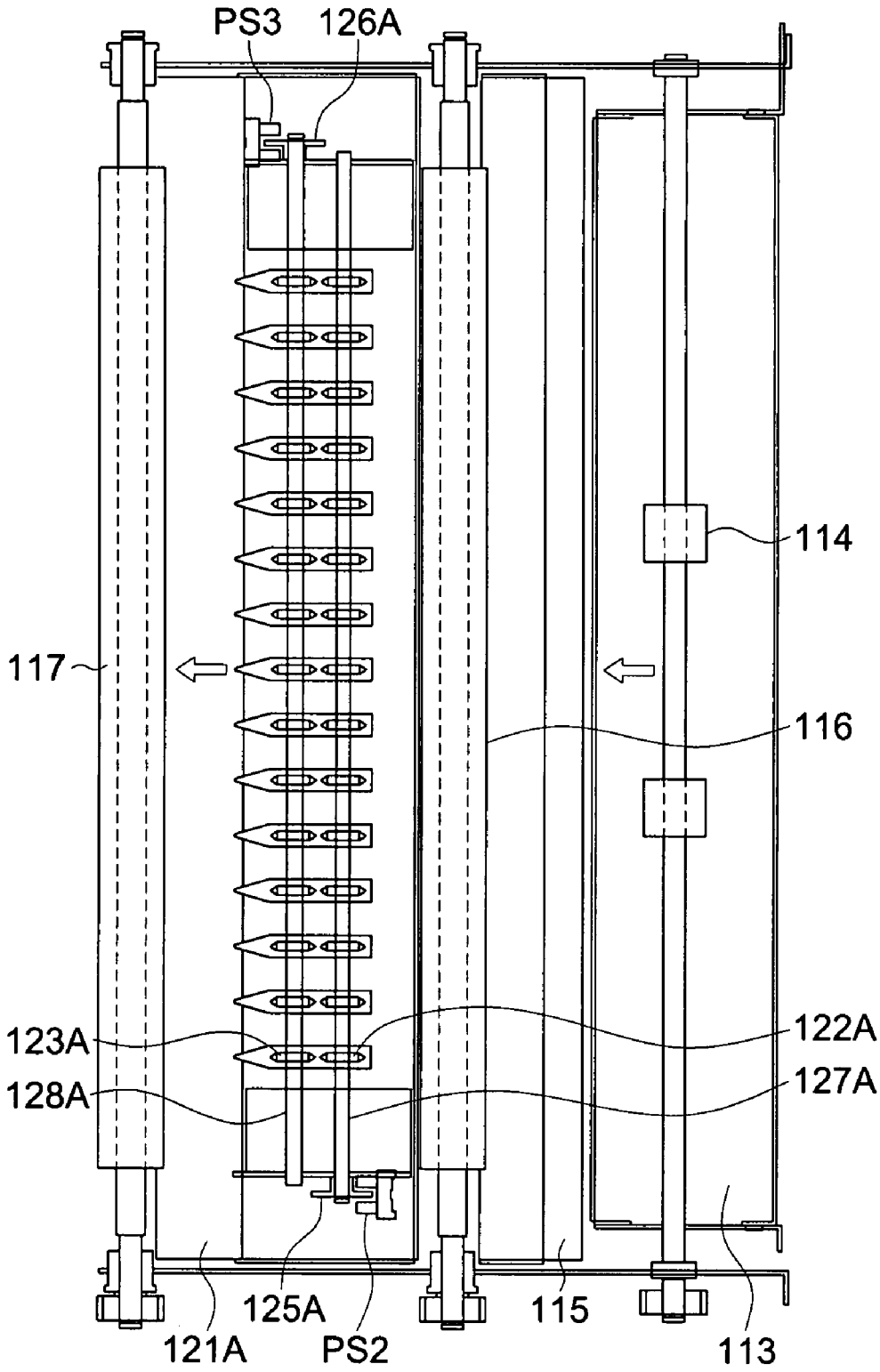
FIG. 3 is a plan view of a curl detecting section.

FIG. 3 is a plan view of the curl detecting section 120. Because the curl detecting section 120 is arranged symmetrically with respect to a vertical sheet conveyance path "p" in FIG. 2, the curl detecting member shown on the left will be described.

Each of the conveyance rollers 116, 117 having a drive roller and a driven roller which convey the sheet S interposed therebetween are disposed upstream and downstream of the curl detecting section 120 has an integrated elastic layer in an axial direction longer by the maximum sheet width. The elastic layers of the drive roller and the driven roller of the conveyance rollers 116, 117 are made of the same material having the same rubber hardness.

For example, the elastic layers of the drive roller and the driven roller of the conveyance rollers 116, 117 are made of ethylene propylene rubber (EPDM) or urethane rubber or the like.

Toothed wheels 122A, 123A rotatably supported on a support plate 121A are disposed at predetermined intervals, for example, 15 toothed wheels are disposed at equal intervals of about 15 mm, in the axial direction of a rotational shaft 127A.

A disk-shaped detecting plate 125A is fixed to one axial end of the rotational shaft 127A which has a plurality of toothed wheels 122A fixed thereto and is rotatably supported on the support plate 121A. The rotational angle of the detecting plate 125A is detected by a sensor PS2.

A disk-shaped detecting plate 126A is fixed to one axial end of a rotational shaft 128A which has a plurality of toothed wheels 123A fixed thereto and is rotatably supported on the support plate 121A. The rotational angle of the detecting plate 126A is detected by a sensor PS3.

The curl detecting member having a support plate 121B and toothed wheels 122B, 123B of the curl detecting section 120 on the right-hand side in FIG. 2 has a configuration similar to that of the curl detecting member having the support plate 121A and toothed wheels 122A, 123A on the left-hand side in the diagram, and both members are arranged line-symmetrical to the vertical sheet conveyance path "p".

The toothed wheels 122A, 123A, 122B, 123B which detect a curl at the leading edge portion of the sheet are disposed across the entire sheet in the widthwise direction, and detect the curling amount and the curling direction with respect to various sizes of sheets to be conveyed. The toothed wheels can detect a curl at a corner portion of the sheet and curls generated at both widthwise edge portions of the sheet besides a curl at the leading edge portion of the sheet.

Figure 4:
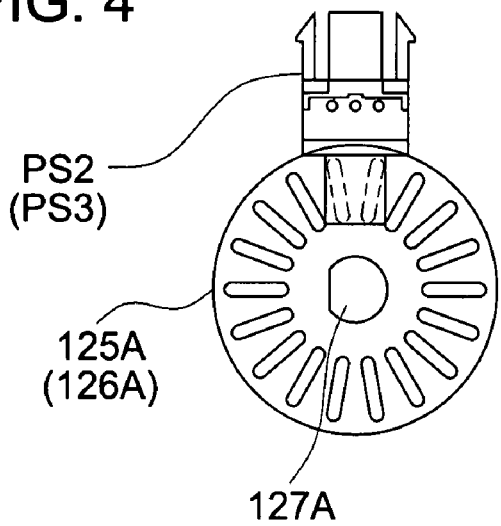
FIG. 4 is a front view of a detecting plate and a sensor.

FIG. 4 is a front view of the detecting plate 125A and the sensor PS2.

A plurality of elliptical holes (slits) are bored through the disk-shaped detecting plate 125A fixed to the axial end of the rotational shaft 127A, and the rotational angle of the detecting plate 125A is detected by the translucent sensor PS2.

The detecting plate 126A disposed at the axial end of the rotational shaft 128A and the sensor PS3, and the unillustrated detecting plate and sensor of the toothed wheels 122B, 123B likewise have the same shapes as the detecting plate 125A and the sensor PS2.

Figure 5:
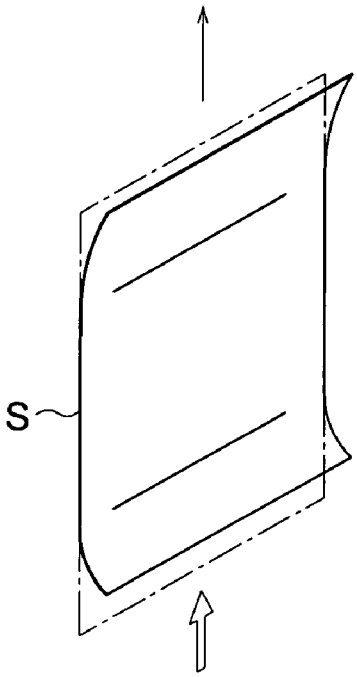
FIG. 5(*a*)-5(*c*) are perspective views showing various curls of a sheet.
Figure 5:
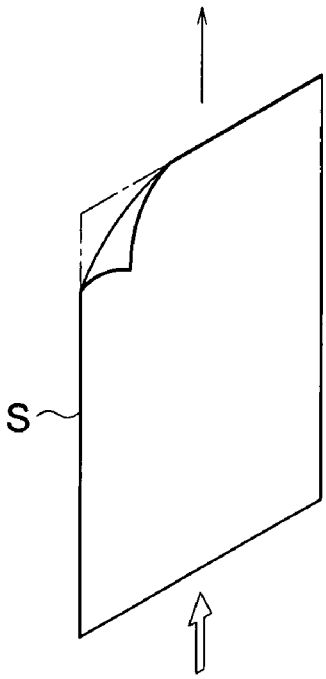
Figure 5:
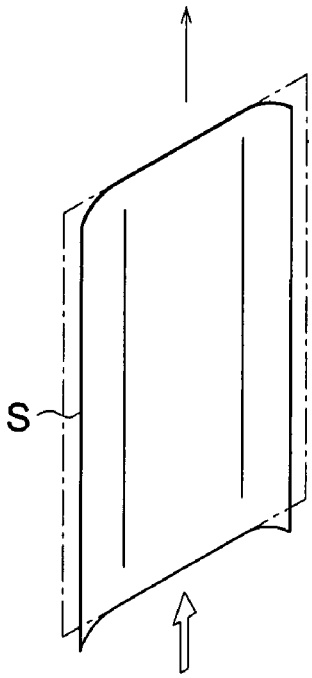

FIGS. 5(*a*)-5(*c*) are perspective views showing various curls of the sheet S. FIG. 5(*a*) shows a lead-edge curl and a trail-edge curl generated in the sheet conveying direction. FIG. 5(*b*) shows a corner curl generated at a corner of the leading edge in the sheet conveying direction. FIG. 5(*c*) shows a side curl generated on the side-edge portion in parallel to the sheet conveying direction.

Figure 6:
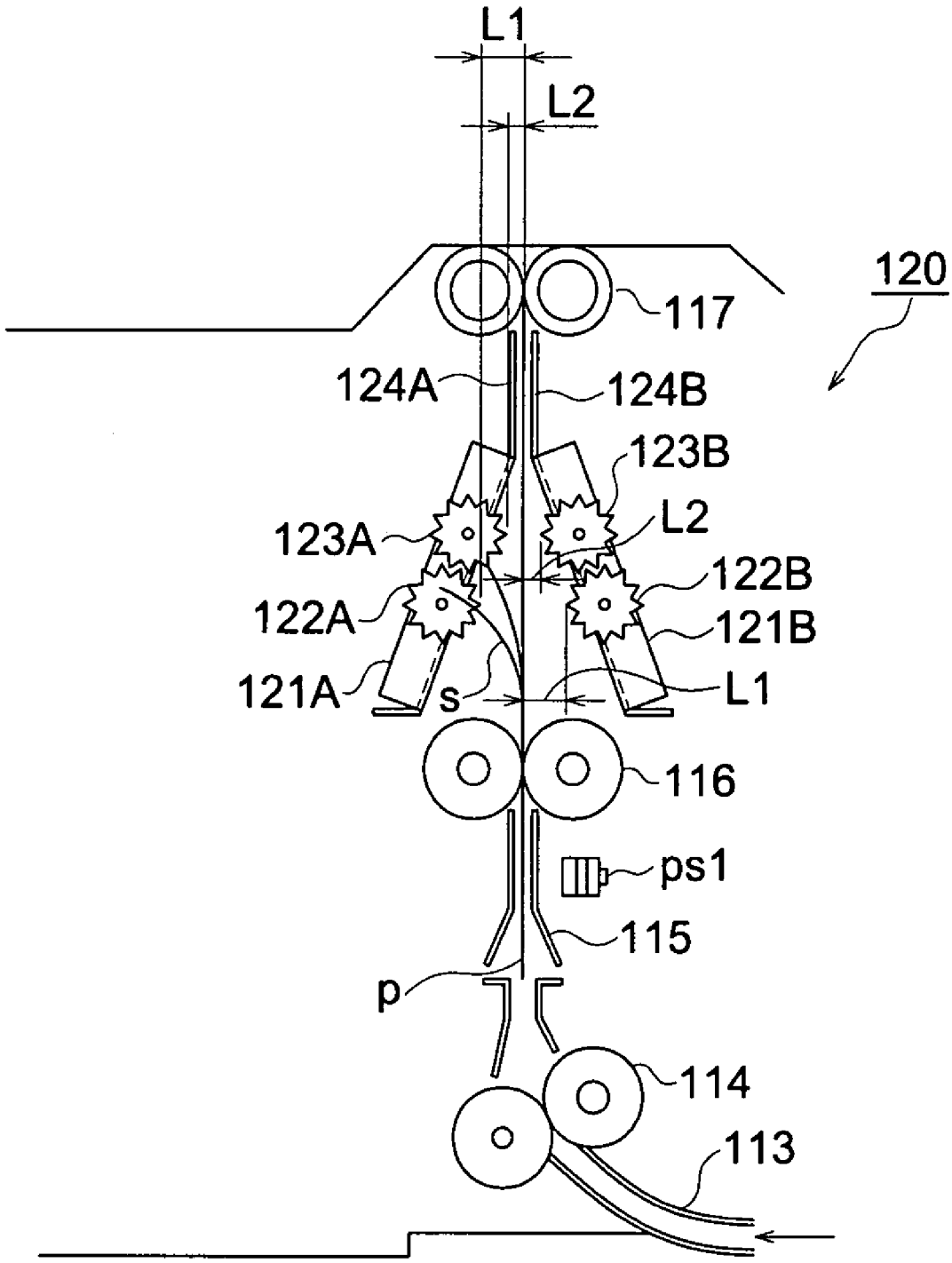
FIG. 6 is a cross-sectional view showing layout positions of toothed wheels of the curl detecting section.
Figure 7:
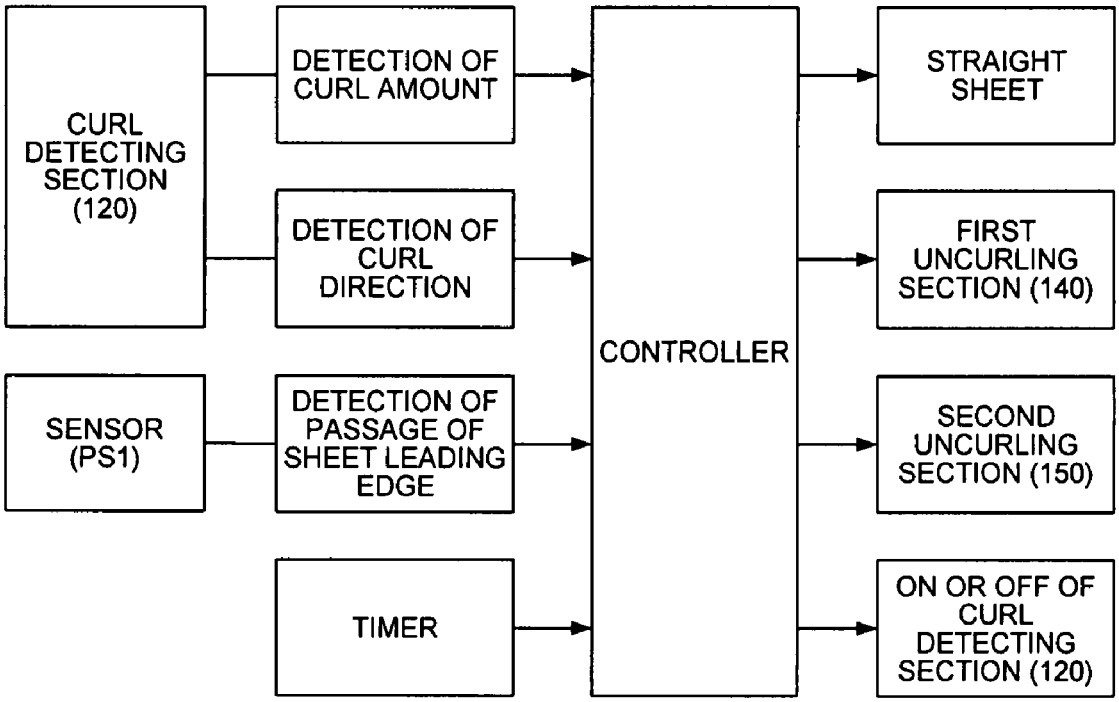
FIG. 7 is a block diagram showing control of the curl detecting section, a first uncurling section and a second uncurling section.

FIG. 6 is a cross-sectional view showing layout positions of the toothed wheels 122A, 123A, 122B, 123B of the curl detecting section 120. FIG. 7 is a block diagram showing control of the curl detecting section 120, the first uncurling section 140 and the second uncurling section 150.

The toothed wheels 122A, 122B disposed horizontally symmetrically facing each other with the vertical sheet conveyance path "p" in between detect a large curl of 10 mm or larger on the sheet S. The toothed wheels 123A, 123B detect a small curl of 5 to 10 mm on the sheet S.

A distance L1 at which the vertical sheet conveyance path "p" connecting the nip position of the conveyance rollers 116 to the nip position of the conveyance rollers 117 faces the outside diameter of the toothed wheels 122A is set to 10 mm. The distance L1 at which the vertical sheet conveyance path "p" faces the outside diameter of the toothed wheels 122B is also set to 10 mm.

A distance L2 at which the vertical sheet conveyance path "p" faces the outside diameter of the toothed wheels 123A is set to 5 mm. The distance L2 at which the vertical sheet conveyance path "p" faces the outside diameter of the toothed wheels 123B is also set to 5 mm.

When the sensor PS2 detects that the leading edge portion of the sheet S which is interposed and conveyed to the vertical sheet conveyance path "p" by the conveyance rollers 114, 116 abuts on any of the toothed wheels 122A, 122B and rotates, a large curl of 10 mm or larger on the sheet S and the curling direction are detected.

Likewise, when the sensor PS3 detects that the leading edge portion of the sheet S abuts on any of the toothed wheels 123A, 123B and rotates, a small curl of 5 to 10 mm on the sheet S and the curling direction are detected.

Based on the curling amount and the curling direction detected by the curl detecting section 120, one of the first uncurling section 140 and the second uncurling section 150 which reduces curling is selected to uncurl the sheet S.

The sensor PS1 disposed upstream of the conveyance rollers 116 in the sheet conveying direction detects passing of the leading edge portion of the sheet S passing along the vertical sheet conveyance path "p". A predetermined time from the arrival of the leading edge portion of the sheet at the curl detecting section 120 and completion of the passing is preset, and the control is executed in such a way that the rotation of the toothed wheels 122A, 122B, 123A, 123B originating from the abutment of the leading edge portion of the sheet S within the predetermined time is detected by the sensor PS2, PS3.

Although the foregoing description of the embodiment has been given of an image forming apparatus which has the decurl device B and the sheet finisher FS connected to a copy machine, the invention can be adapted to an image forming apparatus which has the decurl device B and the sheet finisher FS connected to the image forming apparatus main body A of a printer, a facsimile, a digital multi-functional machine or the like. The invention can be used as a single decurl device B.

The toothed wheels of the curl detecting section which detect the amount of curling at the leading edge portion of a curled sheet and the curling direction are disposed across the entire sheet in the widthwise direction, and detect the curling amount and the curling direction with respect to various sizes of sheets to be conveyed. The toothed wheels can detect a curl at a corner portion of the sheet and curls generated at both widthwise edge portions of the sheet as well as a curl at the leading edge portion of the sheet.

Based on the curling amount and the curling direction detected by the curl detecting section, one of a plurality of uncurling sections which reduces curling is selected to uncurl a curl of a sheet.

In the image forming apparatus having the image forming apparatus main body, the decurl device and the sheet finisher connected together, the decurl device cancels curling, waving or the like of a sheet to be ejected from the image forming apparatus main body, and sheets with a good flatness are fed to the sheet finisher, and a high-quality booklet is made after the finishing process.

What is claimed is:

1. A decurl device comprising:

(a) a curl detecting section having a plurality of toothed wheels each which detects a curling amount and a curling direction of a sheet having a curl; and (b) a plurality of uncurling sections each arranged downstream of the curl detecting section in a conveyance direction of the sheet having the curl, which uncurls the sheet by bending and transforming the sheet in a direction reverse to a curling direction thereof, wherein one of the uncurling sections, which reduces the curl, is selected on the basis of the curling amount and the curling direction that have been detected by the curl detecting section, thereby uncurling the sheet.

2. The decurl device of claim 1, wherein the curl detecting section comprises:

a pair of support plates spaced symmetrically apart from each other with respect to a sheet conveyance path, and at least a pair of toothed wheels rotatably supported on each of the pair of support plates; and a sensor which detects a rotation of each of the pair of toothed wheels, wherein the sensor detects the curling amount and the curling direction of the sheet by detecting that a leading edge of the sheet conveyed in the sheet conveyance path comes into contact with any one of the toothed wheels and thereby rotates any one of the toothed wheels.

3. The decurl device of claim 1, wherein a plurality of toothed wheels are rotataby supported on each of the pair of support plates, and a distance between a supported position of each of the plurality of toothed wheels and a center of the sheet conveyance path is different from each other.

4. The decurl device of claim 1, wherein the plurality of toothed wheels are provided at constant spaced intervals over a whole area of a sheet width.

5. The decurl device of claim 2, wherein the sensor detects the rotation of the toothed wheels by detecting slits provided on a discoid detection plate which is fixed on an end portion of a rotary shaft of each of the toothed wheels.

6. The decurl device of claim 2, wherein the sheet conveyance path provided in the vicinity of the curl detecting section is vertically arranged.

7. The decurl device of claim 1, further comprising conveying rollers each having a drive roller and a driven roller engaged with the drive roller, which are provided upstream and downstream of the curl detecting section, and convey the sheet while interposing the sheet, wherein each of the conveying rollers has a resilient layer which has been integrally formed, is longer than a maximum width of sheets to be conveyed.

8. The decurl device of claim 7, wherein the resilient layer of the drive roller and the driven roller is formed by the same material having the same rubber hardness.

9. The decurl device of claim 1, wherein the plurality of uncurling sections comprises:

a first uncurling section which uncurls a sheet in which a curl concave upward is formed; and a second uncurling section which uncurls a sheet in which a curl convex upward is formed.

10. The decurl device of claim 2, wherein the sensor detects the curling amount and the curling direction of the sheet by detecting that a leading edge of the sheet conveyed in the sheet conveyance path comes into contact with any one of the toothed wheels and thereby rotates any one of the toothed wheels, and wherein one of the uncurling sections, which reduces the curl, is selected, thereby uncurling the sheet.

11. The decurl device of claim 1, further comprising a sensor provided upstream of the curl detecting section in the conveyance direction of the sheet, which detects a passage of a leading edge of the sheet, a prescribed period of time that the leading edge of a sheet reaches the curl detecting section is preset, and the sensor detects a rotation of the toothed wheel only within the prescribed period of time.

12. An image forming apparatus comprising:

(a) an image forming apparatus main body which forms an image on a sheet;

(b) the decurl device of claim 1; and (c) a sheet finisher which finishes the sheet that has been ejected from the decurl device.

* * * * *